US005207153A

United States Patent [19]

Thomason

[11] Patent Number: 5,207,153

[45] Date of Patent: May 4, 1993

[54] APPARATUS FOR APPLYING PRINTED MATTER TO OBJECTS

[76] Inventor: Harry Thomason, 14 Cleworth Close, Astley, Manchester M29 7JF, England

[21] Appl. No.: 799,100

[22] Filed: Nov. 27, 1991

[30] Foreign Application Priority Data

Nov. 28, 1990 [GB] United Kingdom ..... 9025900

[51] Int. Cl.[5] ..... B41F 17/18; B41F 17/28

[52] U.S. Cl. ..... 101/35; 101/44

[58] Field of Search ..... 101/35, 41, 42, 43, 101/44; 346/140 R

[56] References Cited

U.S. PATENT DOCUMENTS

| | | | |
|---|---|---|---|
| 3,641,930 | 2/1972 | Riddington | 101/35 |
| 3,765,326 | 10/1973 | Hawkins | 101/44 |
| 3,877,367 | 4/1975 | Norwood | 101/44 |
| 4,078,483 | 3/1978 | Gall | 101/44 |
| 4,308,793 | 1/1982 | Schmidt | 101/41 X |
| 4,889,050 | 12/1989 | Meador | 101/38.1 |

FOREIGN PATENT DOCUMENTS 1098120 1/1968 United Kingdom .

*Primary Examiner*—J. Reed Fisher

*Attorney, Agent, or Firm*—Fisher, Christen & Sabol

[57] ABSTRACT

Apparatus for applying printed matter onto objects (10) has a conveyor (11) on which objects (36) are carried under one or more printing heads (16). The conveyor (11) is formed by multiple rotatable conveyor bodies (12) and is driven by a drive roller (18). The printing head (16) is also connected to the drive roller (18) by way of a linkage (14) which permits driving of the printing heads in a reciprocating manner. An accelerator device (13) is also drivably connected to the drive roller (18) and acts to rotate the conveyor bodies (12) which form the conveyor. In use, objects (36) on the conveyor (11) are rotated by the rotation of the conveyor bodies (12) under the action of the accelerator device (13), the rate of this rotation being matched to the rate of reciprocation of the printing heads (16) whereby a stationary surface on the object (36) is presented for printing.

20 Claims, 1 Drawing Sheet

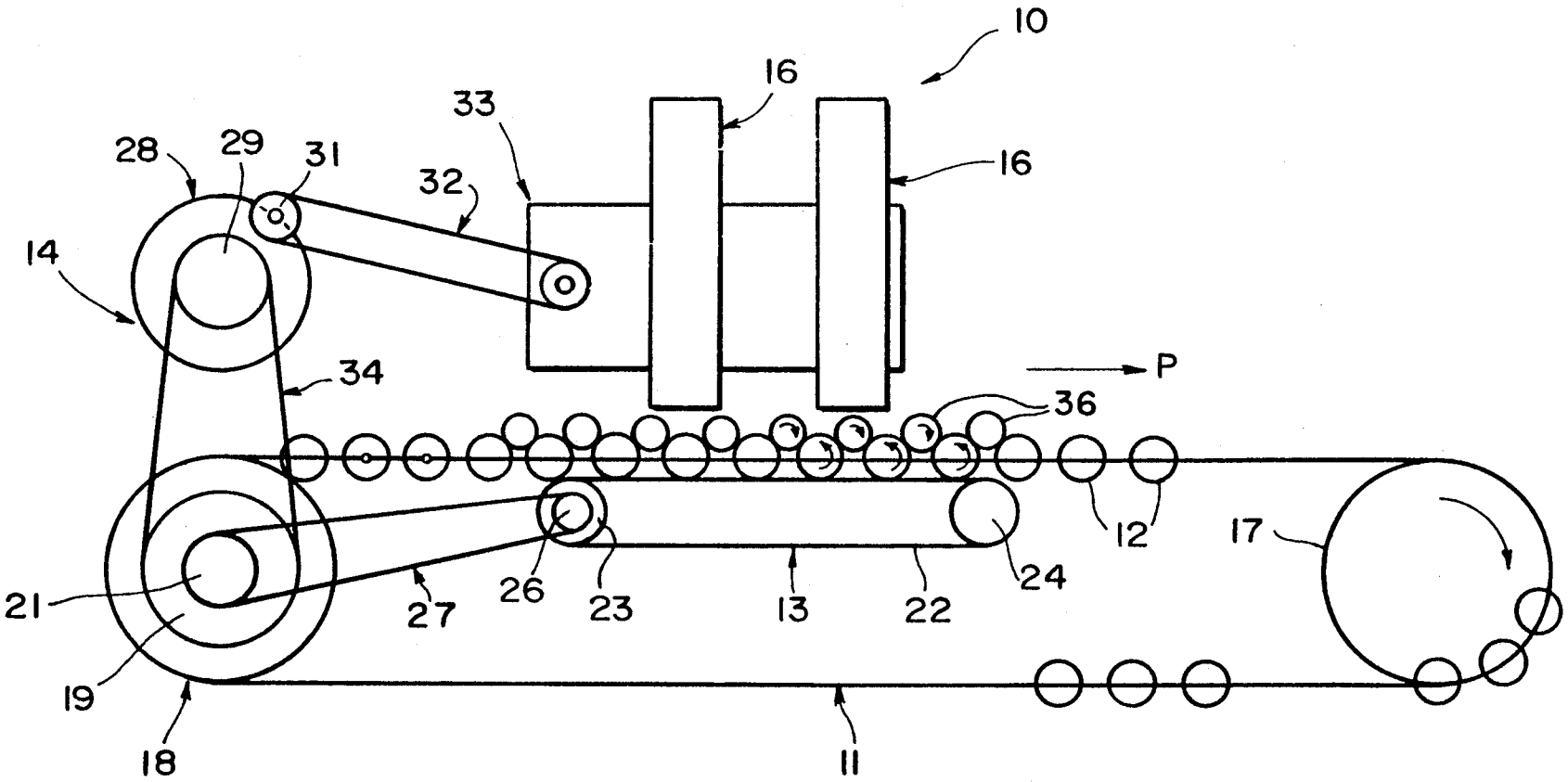
10
16
16
33
32
31
29
28
14
34
P
36
12
17
24
22
13
23
26
27
21
19
18
11

APPARATUS FOR APPLYING PRINTED MATTER TO OBJECTS

This invention relates to apparatus for applying printed matter to objects and more particularly for applying such matter to moving objects.

When applying printed matter to moving objects it can be difficult to ensure that the printing head applies the matter in consistent placement thereon and without smudging. This is particularly a problem when the printed matter is to be applied to objects of generally circular cross-section whereby it can be difficult to arrange for there to be no relative movement between the printing head and the moving surface, which is necessary to ensure the quality of the printed matter applied thereto. Conventional apparatus for this purpose is slow in operation and is not capable of producing high resolution of printed matter applied to the object.

It is an object of the present invention to provide apparatus which enables the fast and accurate application of printed matter to objects, particularly those of circular cross-section.

According to the present invention therefore there is provided apparatus for applying printed matter onto objects comprising conveying means on which objects to be printed are carried, accelerating means linked to printing means in such a manner that actuation of said conveying means causes a movement of said printing means relative to said conveying means, the rate of said movement and movement of said conveyor being matched such that said printing means can apply printed matter to a surface of said object.

With this arrangement it is possible to apply printed matter to objects in a fast and efficient manner.

Preferably said movement of said printing means comprises an oscillating movement and said oscillating movement may be substantially parallel to the direction of movement of said conveying means.

The invention will now be described further by way of example only and with reference to the accompanying drawings, the single FIGURE of which shows a schematic representation of one form of apparatus according to the invention.

Referring now to the Figure, there is shown apparatus 10 for applying printed matter to moving objects comprising a product conveyor 11 formed from multiple support bodies 12 mounted for free rotation about an axis thereof transversely to the direction of movement of the conveyor denoted by P in the Figure, an accelerator device 13 and a linkage 14 linking said accelerator device 13 and one or more printing heads 16.

The product conveyor 11 comprises multiple cylindrical support bodies 12 linked across opposite respective ends to form an endless conveyor 11. The support bodies 12 are mounted in the conveyor 11 so as to be freely rotatable about their own respective longitudinal axis for a purpose to be described hereinafter. The conveyor 11 is supported on a rotatable support roller 17 disposed at one end thereof and a drive roller 18 disposed at another end thereof. The drive roller 18 is stepped in the transverse direction to define two projecting portions 19, 21 of reduced diameter to the remainder of the drive roller 18 for a purpose to be described hereinafter.

The accelerator device 13 comprises an endless belt 22 mounted on two belt support rollers 23, 24.

The belt 22 has two opposed parallel runs thereto and the device 13 is located relative to the product such that one of the runs extends generally parallel to a run of the conveyor and such that the run of the belt 22 is in frictional contact with a lower surface of each of the rotatable bodies 12 adjacent thereto. Thus it will be appreciated that movement of the belt 22 will cause rotation of the bodies 12 due to the frictional contact therewith. One belt support roller 23 has a projecting part 26 of reduced diameter to the remainder thereof and this part 26 is drivably linked to the drive roller 18 of the conveyor 11 by way of an accelerator belt 27 whereby the accelerator device 13 can be driven in conjunction with the product conveyor 11.

The linkage 14 comprises a linkage roller 28 also having a projecting part 29 of reduced diameter to the remainder thereof and including a circumferentially mounted engagement pin 31. The engagement pin 31 secures one end of a lever pivotally to the periphery of the linkage roller 28 and the other end of the lever 32 is pivotally secured to a mounting 33 which holds two printing heads 16. Of course any number of printing heads 16 can be incorporated in the mounting 33 as desired or as appropriate. The linkage roller 28 is drivably connected to the conveyor drive roller 18 by way of a further linkage belt 34.

The printing heads 16 comprise conventional ink jet printing heads but of course alternatively can comprise any form of printing head as desired or as appropriate.

In use conveyor drive roller 18 is connected to a conventional motor drive arrangement (not shown) which is operable to drive the roller 18 in a rotary fashion. The rotary driving of drive roller 18 causes rotary driving of both belt support roller 23 and linkage roller 28. Due to the difference in drive diameters of the respective rollers (i.e. the diameter of the roller part linked with a drive belt) it can be seen that belt support roller 23 will be driven with a considerably larger angular velocity than the conveyor drive roller 10, and the linkage roller 28 will be driven with an angular velocity intermediate that of the belt support roller 23 and the conveyor drive roller 18. It will of course be appreciated that by suitable arranging of the relative drive diameters it is possible to arrange for the belts 27, 34 and lever 32 to be driven at any desired velocity relative to each other.

The driving of the conveyor drive roller 18 causes movement of the conveyor 11 and thus the object 36 thereon to be moved in the direction denoted by arrow P. The objects 36 carried on the conveyor 11 are generally of circular cross-section, however the arrangement is suitable for use with other configurations of object.

The objects 36 are carried into the region of the accelerator belt 22. In this region, as previously discussed, the accelerator belt 22 is driven at an increased speed relative to the speed of movement of the conveyor 11 and due to the frictional contact between the belt 22 and the support bodies 12 of the conveyor 11, the support bodies 12 are caused to rotate about their axes. Rotation of the support bodies 12 by the action of the belt 22 causes rotation of the object 36 provided thereon in the opposite sense thereto.

The driving of the conveyor drive roller 18 also causes driving of the linkage roller 28 by way of friction linkage belt 34. The rotary driving of linkage roller 28 causes a reciprocating movement of lever 32 connected to peripheral engagement pin 31. Movement of the lever 32 causes a reciprocating movement of the mounting 33 and the associated printing heads 16 in the direction indicated by the arrow P.

Thus it will be appreciated that as each object 36 is carried by the conveyor 11 into the region of the run of the belt 22, it is rotated in a generally clockwise direction, by rotation of the support bodies 12 in an anticlockwise direction, and the printing heads 16 are caused to reciprocate in a direction parallel to the direction of movement of the objects 36. Thus it can be arranged that the rate of reciprocation of the printing heads 16 is equal to the tangential velocity of the outer surface of the object 36 to be printed upon when rotated by the action of the belt 22, whereby a stationary surface is presented for printing upon the convex outer surface of the object 36. The printed matter can thus be applied on this stationary surface by the ink jet printing heads 16. The fact that a stationary surface can be presented to the printing heads 16 for printing despite the fact that the objects 36 are circular in shape enables the use of a high speed, high resolution and accurate ink jet projecting head. Thus with this arrangement it will be appreciated that it is possible to conveniently and simply arrange for matter to be printed onto a convex outer surface of an object of circular cross-section with considerable accuracy and resolution.

It is of course to be understood that the invention is not intended to be restricted to the details of the above embodiment which are described by way of example only.

Whilst the above embodiment is described in relation to printing matter onto the curved outer surface of an object of circular cross-section, it will of course be appreciated that with the arrangement of the present invention it is possible to increase the accuracy and resolution of printed matter applied to any configuration of object and to decrease the occurrence of smudging when applying the printed matter thereto. This arises due to the provision of the moving, and in particular oscillating, printing heads which act to remove any relative movement between the head and surface of the object when the printed matter is applied.

I claim:

1. Apparatus for applying printed matter onto objects, said apparatus comprising conveying means on which objects to be printed are carried, object drive means operable to cause movement of said objects relative to said conveying means and printing means to apply printed matter to the objects, said object drive means and said printing means being operatively linked to said conveying means by a linkage whereby movement of said conveying means causes movement of said printing means and said objects relative to said conveying means, the rate of movement of the conveying means, and movement of the objects and printing means relative to the conveying means being matched whereby printed matter can be applied to the surface of the objects.

2. Apparatus according to claim 1 wherein movement of the printing means is a reciprocating movement.

3. Apparatus according to claim 2 wherein said reciprocating movement is a linear reciprocating movement in a direction substantially parallel to the direction of movement of said conveying means.

4. Apparatus according to claim 1 wherein said conveying means is adapted to be driven by conveyor drive means, and said printing means and said object drive means are linked to said conveyor drive means.

5. Apparatus according to claim 4 wherein said printing means is linked to said conveyor drive means by way of a linkage, said linkage comprising a roller adapted to be driven by said conveyor drive means and a lever interconnecting said roller and said printing means.

6. Apparatus according to claim 5 wherein said roller comprises a circumferentially mounted engagement pin, said lever arm being connected between said engagement pin and said printing means.

7. Apparatus according to claim 1 wherein said conveying means comprises an endless belt formed from multiple conveyor bodies, said bodies being independently rotatable relative to said conveying means.

8. Apparatus according to claim 1 wherein said object drive means comprises an endless belt drivably connected to said conveying means.

9. Apparatus according to claim 7 wherein said object drive means is operable to drivably rotate said conveyor bodies so as to rotate said objects on said conveying means.

10. Apparatus according to claim 2 wherein said conveying means is adapted to be driven by conveyor drive means, and said printing means and said object drive means are linked to said conveyor drive means.

11. Apparatus according to claim 3 wherein said conveying means is adapted to be driven by conveyor drive means, and said printing means and said object drive means are linked to said conveyor drive means.

12. Apparatus according to claim 10 wherein said printing means is linked to said conveyor drive means by way of a linkage, said linkage comprising a roller adapted to be driven by said conveyor drive means and a lever interconnecting said roller and said printing means, said roller comprising a circumferentially mounted engagement pin, said lever arm being connected between said engagement pin and said printing means.

13. Apparatus according to claim 2 wherein said conveying means comprises an endless belt formed from multiple conveyor bodies, said bodies being independently rotatable relative to said conveying means.

14. Apparatus according to claim 4 wherein said conveying means comprises an endless belt formed from multiple conveyor bodies, said bodies being independently rotatable relative to said conveying means.

15. Apparatus according to claim 5 wherein said conveying means comprises an endless belt formed from multiple conveyor bodies, said bodies being independently rotatable relative to said conveying means.

16. Apparatus according to claim 2 wherein said object drive means comprises an endless belt drivably connected to said conveying means.

17. Apparatus according to claim 4 wherein said object drive means comprises an endless belt drivably connected to said conveying means.

18. Apparatus according to claim 12 wherein said object drive means comprises an endless belt drivably connected to said conveying means.

19. Apparatus according to claim 8 wherein said object drive means is operable to drivably rotate said conveyor bodies so as to rotate said objects on said conveying means.

20. Apparatus according to claim 14 wherein said object drive means is operable to drivably rotate said conveyor bodies so as to rotate said objects on said conveying means.

* * * * *